United States Patent [19]

Brewer et al.

[11] Patent Number: 4,593,790

[45] Date of Patent: Jun. 10, 1986

[54] CONVERTIBLE LADDER STABILIZER

[76] Inventors: James S. Brewer, 401 Rockcliff Dr.; William P. Allen, Rte. 1, Box 137, both of Martinsburg, W. Va. 25401

[21] Appl. No.: 724,258

[22] Filed: Apr. 17, 1985

[51] Int. Cl.[4] ..... E06C 7/48

[52] U.S. Cl. ..... 182/214; 182/107

[58] Field of Search ..... 182/214, 107, 108, 120, 182/121; 248/238

[56] References Cited

U.S. PATENT DOCUMENTS

| | | | |
|---|---|---|---|
| 2,592,006 | 4/1952 | Burke | 182/214 |
| 2,903,086 | 9/1959 | Chubbs | 182/214 |
| 3,028,929 | 4/1962 | Chubbs | 182/214 |
| 3,288,249 | 11/1966 | Gibson | 182/214 |
| 3,715,012 | 2/1973 | Perry | 182/214 |
| 3,773,143 | 11/1973 | Del Prete | 182/214 |
| 4,311,210 | 1/1982 | Jackson | 182/214 |

*Primary Examiner*—Reinaldo P. Machado
*Attorney, Agent, or Firm*—John G. Semmes

[57] ABSTRACT

A multi-purpose convertible ladder stabilizer, particularly adapted to stabilize the upper free end of ladders such as the extension type during utility in the construction, maintenance, repair, painting of commercial and domestic buildings. The stabilizer is characterized by its portability and function convertibility wherein it may be removably set for disposition as an outside corner clutch, an inside corner engager, a building overhang ladder attachment, window spanner and the like. A coactive relationship is provided between elements wherein interconnected articulable extensions and a ladder during use, irrespective of the geometric vertical configuration of that elevated part of a building which may be considered the workplace.

7 Claims, 7 Drawing Figures

CONVERTIBLE LADDER STABILIZER

BACKGROUND OF THE INVENTION

The invention in its broadest aspect comprises a convertible multi-purpose extension ladder attachment which when folded and bracketed at specific points therein is capable of performing five interrelated functions wherein ladder stability may be enhanced. When not in use, the stabilizer is adapted to a composite elongated package which may be readily hung or stored in an upright position, hereinafter described.

The prior art is best represented by the following patents, each of which is distinguishable on grounds which will be apparent from the ensuing description and drawings.

James A. Burke—U.S. Pat. No. 2,592,006
Howard L. Chubbs—U.S. Pat. No. 3,028,929
Adelbert W. Perry—U.S. Pat. No. 3,715,012
Jacob L. Jackson—U.S. Pat. No. 4,311,210

SUMMARY OF THE INVENTION

This is a multi-purpose attachment for extension ladders in particular, the primary function of which is to lend stability to the extension ladder at its upper free end which normally rests against one or more regular and irregular faces of a building. For example, heretofor when a workman desires to place an extension ladder in position relative to the corner of a building so that he might work on both walls simultaneously, a ladder imbalance would usually result, thereby endangering the workman. By the same token, a ladder imbalance may result where the normal extension ladder may be applied to an inside corner, the points of inpingement of the ladder on the wall being two only and having no flat contiguous connection of the ladder to the building per se. Likewise, it was formerly dangerous when it was desired to work on overhangs or on the surfaces above and below same. Additionally, in the replacement, repair, caulking of windows and the like no means were provided herein for spanning the window, whereby the workman may position himself opposite the window without fear of imbalance, slipping or otherwise having the ladder interfere with his work.

It is to overcome these deficiencies in function that the present invention was created. The means for providing convertible stability to accommodate the specific building elevated workplace are defined hereinafter by reference to drawings, ensuing description and claims.

DESCRIPTION OF THE PREFERRED EMBODIMENTS

Figure 1:
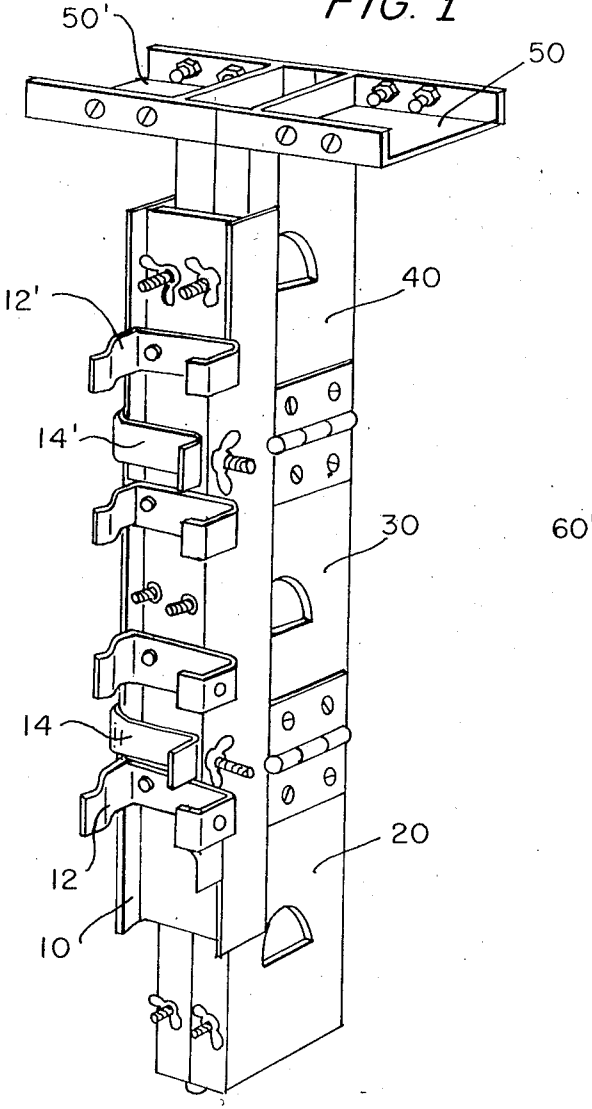
FIG. 1 is a view in perspective of the convertible stabilizer in collapsed storage configuration.

Referring to FIG. 1, the multi-purpose extension ladder stabilizer comprises the following basic components: a rigid connector 10, interconnected articulable dual extensions 20, 30 and 40 as well as permanently fixed end extension 50. In the storage position depicted in FIG. 1, it will be noted that the rigid connector 10 is adapted to secure the respective opposed interconnected articulable extensions 20, 30 and 40 in contiguous relationship to each other, whereby the stabilizer, per se may be hung when end extensions 50–50′ are set in the horizontal position shown at the top of the Figure. By inverting the ladder stabilizer, the end extensions 50–50′ being permanently fixed will form a stand for the stabilizer. Rigid connector 10 is shown to include fixed plural stabilizer clamps 12–12′ and two removable ladder hangers 14–14′. In the storage position, the hangers are confined within a recess formed by the rigid connector 10. As will be more fully described hereinafter, these ladder hangers 14–14′ are adapted to bracket the opposed legs of a given extension ladder, reference subsequent FIGS. 2–6 hereinafter described.

Figure 2:
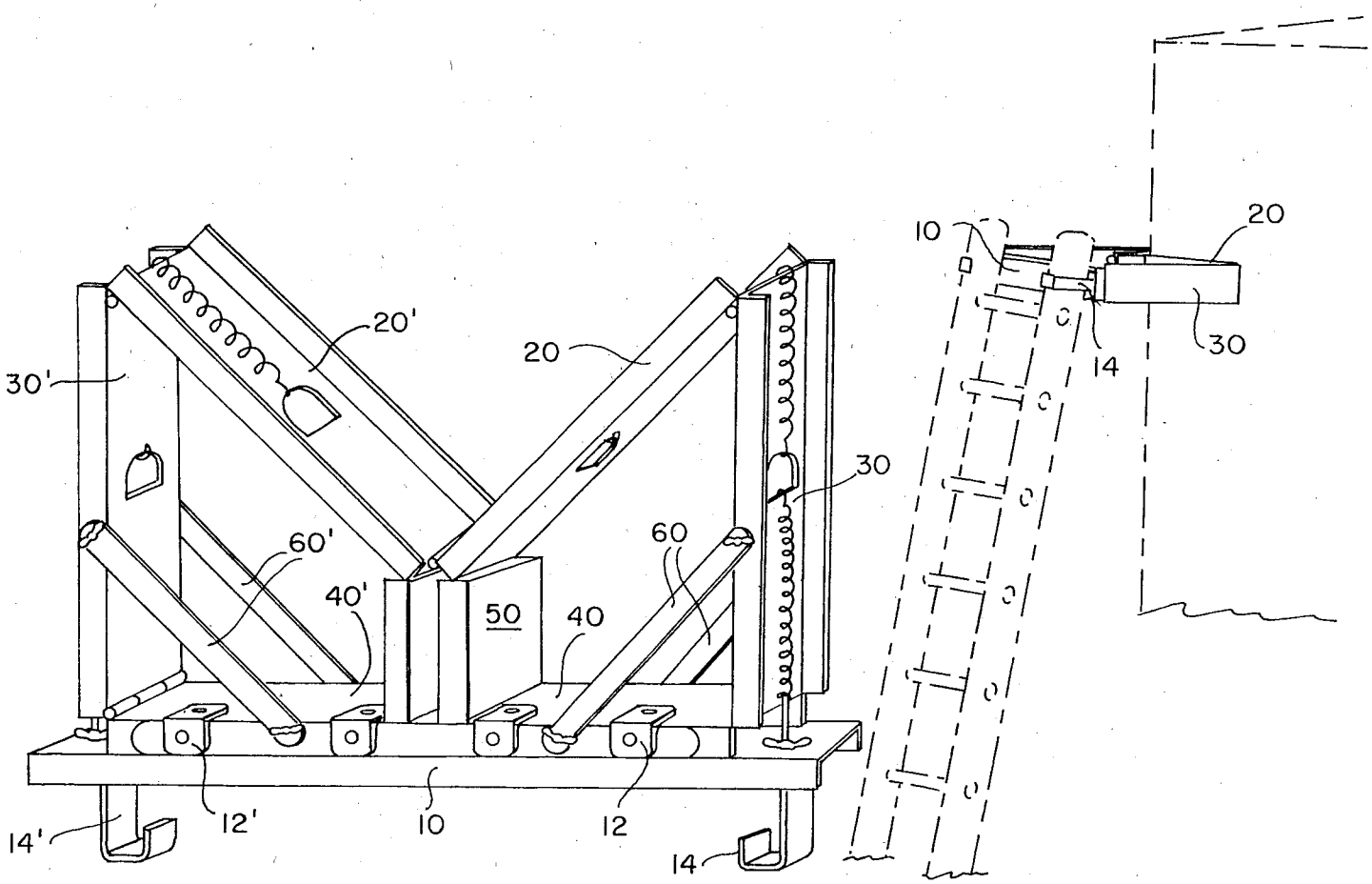
FIG. 2 depicts the stabilizer in corner clutch configuration for securing a ladder to outside corner.
Figure 3:
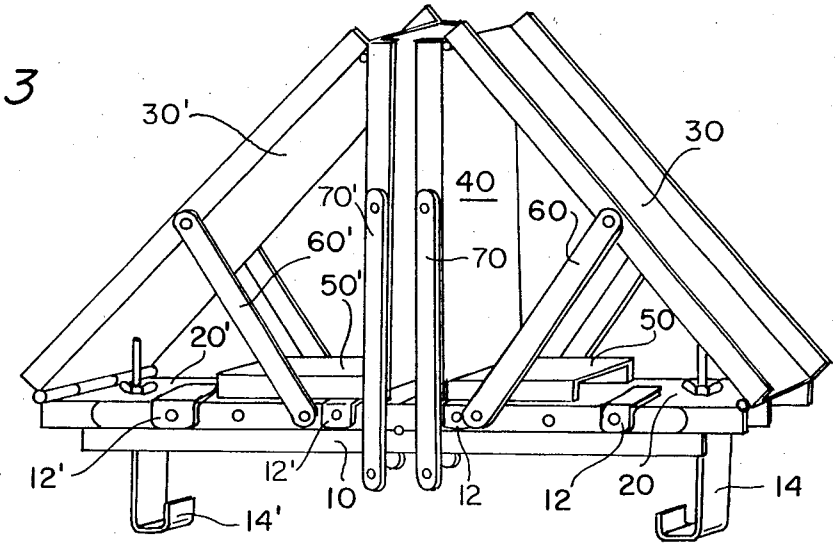
FIG. 3 is an isometric view of inside corner configuration of the stabilizer.
Figure 7:
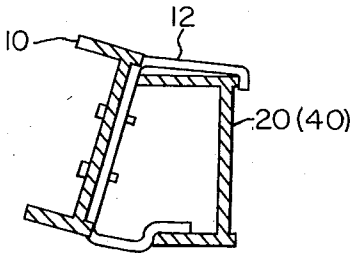
FIG. 7 is an end view of the opposing connector—extension elements and the means whereby they are spaced apart angularly to effect a contiguous contact with the building irrespective of angular displacement of the ladder. See vertical section lines 7—7 of FIG. 6.

Referring to FIG. 2 the ladder stabilizer is depicted in its converted/preferred configuration wherein its function may be achieved as a corner clutch for an extension ladder when it is desired to apply the ladder to a positive angle or outside corner. FIG. 3, on the other hand, is a showing of the opposite of the corner clutch of FIG. 2, wherein the stabilizer is adapted to alternate utility, namely application of the extension ladder to an inside or negative angle corner. To affect the desired assembly and dis-assembly illustrated in FIGS. 1 and 2, the interconnected articulable extensions 20–20′, 30–30′ and 40–40′ are each interconnected by spring-loaded hinges or in the alternative by compression springs leading from one extension to the other, the compression springs shown being anchored in appropriate spring-engaging apertures of the extensions. In this FIG. 2 configuration the articulable extensions 30–30′ are set at a 90 degree angle relative to the extensions 40–40′, said extensions 40–40′ being fixed to the rigid connector 10 by means of its plural connector spacing clamps 12–12′. As shown in FIG. 7, these clamps 12–12′ each include a topmost stabilizer clamp member and lowermost stabilizer clamp member. The lower clamp spacing member diverges from the bottom portion of the clamp 12 at an angle that is substantially greater than 180 degrees. Each clamp spacing member from a side view forms at least one connection, forceably securing the bottom of the rigid connector 10 at an acute angle, relative to the ladder, whereby to place the entire corner clutch arrangement of FIG. 2 and others hereinafter described at a precise right-angle, relative to the upright wall surfaces of the corner of the building to which either of the various configurations may be applied in support of the extension ladder.

Referring once again to FIG. 2, it will be noted that the respectively opposed interconnected extensions 30–30′ are secured against movement by one or more short struts 60–60′. These struts are removably secured at forty-five degree angles relative to corresponding extensions 20–30 and 20′–30′ for purposes of application as a corner clutch in stabilizing an extension ladder. In this particular modification, no further stabilizing is required with respect to extensions 40–50 and/or 40′–50′, since extensions 50–50′, are fixed to and at right angles to extensions 40–40', thereby providing the necessary support for extensions 20–20'.

An alternate utility of the multi-purpose extension ladder stabilizer is depicted in FIG. 3. Here it will be noted that increased angular depression between the articulable extensions 20–30 and 20'–30', 30–40 and 30'–40' results in a configuration wherein the stabilizer may be adapted to a negative angle corner formed by interconnected building walls or otherwise to an inside corner thereof. In this instance, rigidity between elements is achieved by removably securing the struts 60–60' to the corresponding interconnected extensions 20–30, 20'–30'. It will be noted that the extreme extensions 50–50' are now horizontally disposed and lay upon the base extensions 20–20' as opposed to their vertical supporting interrelationship depicted in FIG. 2.

Figure 4:
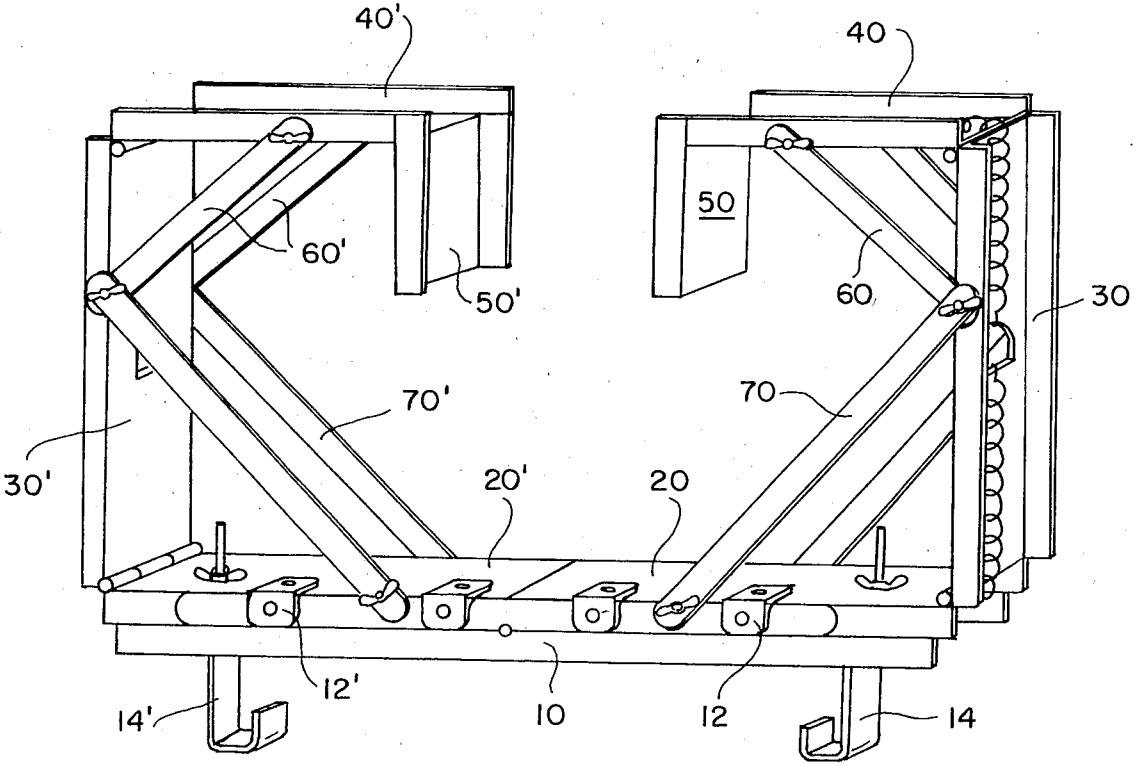
FIG. 4 is an isometric view of the stabilizer in overhang attachment configuration with FIG. 5 depicting extended overhang position.

With reference to FIG. 4 of the drawings, this particular stabilizer configuration is adapted to another alternate utility, wherein the extension ladder is adapted to positioning below a building overhang or ledge. This ladder, while the builder is performing such work as may require the ladder to be positioned from 12 inches to 14 inches from a building wall as for example in spouting repair and/or fascia board repair, painting, etc. In this configuration it will be noted that opposed extensions 30–30' are set into position by the struts 70–70' at right angles to the interconnected extensions 20–20'. These elongated struts 70–70' lend rigidity to the articulable extensions 30–30' and form a stable base for the interconnected extensions 40–40' and their dependent extensions 50–50'. Attention is also directed to the removable interconnection of struts 60–60' between intermediate portions of the 30–30' and 40–40' extensions.

As in all of these modifications, the rigid connector 10 is preferably spaced apart from connecting elements 20–20', thus insuring that the elements 20–20', 40–40', may be angularly set parallel and/or contiguous to the wall of the construction which is under building or repair. This is accomplished through positioning of the stabilizer clamp 12 in such a way that the rigid connector 10 is spaced at its bottom a predetermined distance from the extensions 20–20', or 40–40' with respect to the specific tool configuration. Obviously this distance may be varied.

Figure 5:
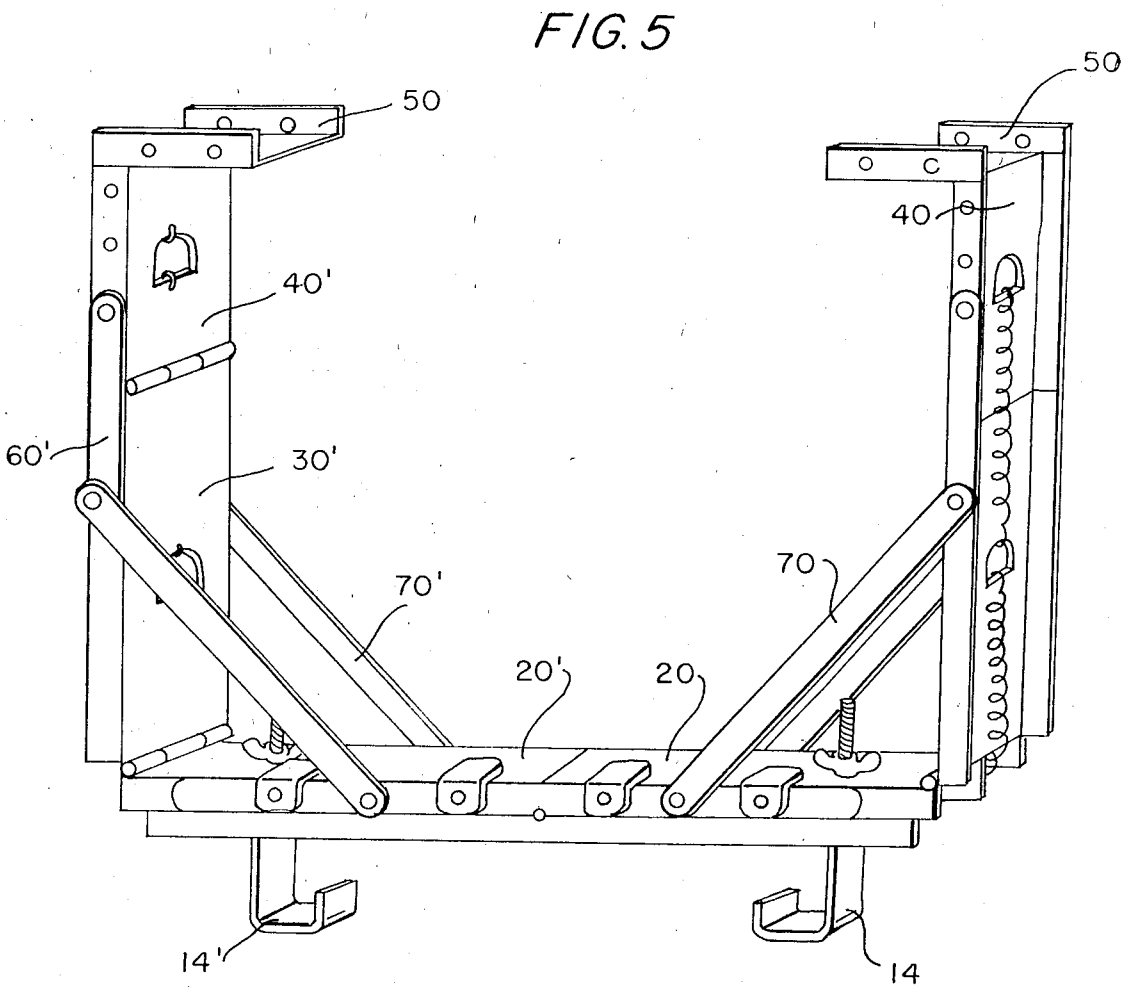

FIG. 5 reveals a modification of the FIG. 4 construction wherein an extended overhang ladder attachment may be affected by the stabilizer, per se. In this configuration the extended overhang attachment is effected by simply elongating the articulable extensions 30–30' through the in-line interconnection of extensions 40–40' as shown. In this instance, short struts 60–60' are set in external alignment with the respective extensions 30–30' and 40–40' to rigidize their interconnection. Elongated struts 70–70' serve the same function here as they do in the parent FIG. 4 assembly.

Figure 6:
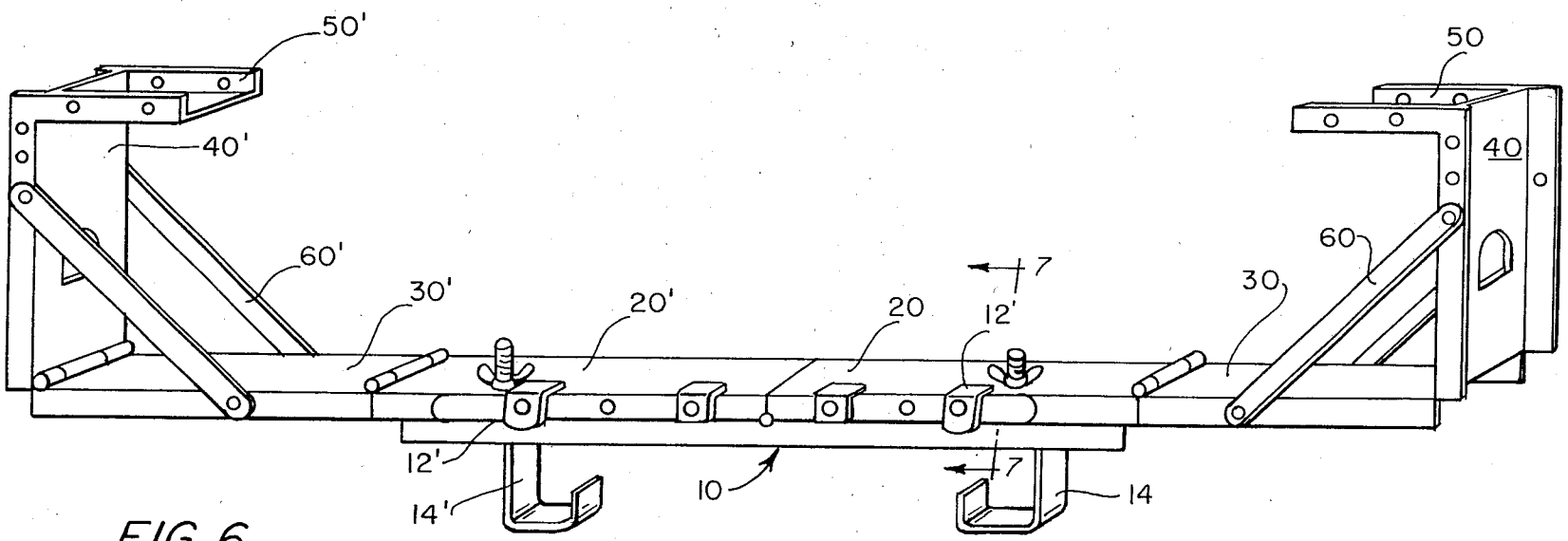
FIG. 6 illustrates the converted position whereby the stabilizer is adapted to a window spanning function.

Referring now to FIG. 6 of the drawings, the ladder stabilizer is depicted in its secondary function as a window spanner. The in-line arrangement between the extensions 20 and 30 on the one hand and 20' and 30' on the other hand will insure extended breadth to the overall construction. The extensions 40–40' are set at right-angles to the base formed by the bottom-most extensions, by means of the struts 60–60'. Here again, as in all of the utility configurations (FIGS. 2–6), the angular disposition of the connector 10 relative to the extensions 20–20', and 40–40' is such that the assembly as a whole will set flush against the building exterior—in this case on the wall which is adjacent the window jamb. See FIG. 7. To confirm, the angular disposition of the ladder relative to the facade of the building is taken into consideration when the stabilizer is applied. This disparity is overcome by the snap-lock engagement of the bottom of clamps 12 with the corresponding bottom edge of the extensions 40–40' FIG. 2 and/or 20–20' FIGS. 3–6 inclusive. When finally positioned, the extensions 20–20' are held to vertical parallel position against the vertical wall of the building. Considering that this wall is on a 0–180 centerline, the connector 10 is held apart at an obtuse angle which is greater than 180. Ideally this angle may be varied, depending upon the detent effect of the holding portions of the element 12.

We claim:

1. An extension ladder stabilizer which is convertible to variant configurations for stable contiguous contact with diverse building surface comprising:

(A) interconnected articulable extensions;

(B) a rigid connector engagable with at least one of said articulable extensions, the connector having at least one removable ladder sidepiece engaging clamp and spacing members on the connector to set the connector at an acute angle which is greater than 90 degrees, relative to a vertical line of the articulable extensions, whereby the stabilizer extensions may conform to the corresponding vertical position of a building surface, irrespective of the angular leaning relation of the ladder to the ground.

2. The extension ladder stabilizer of claim 1 wherein at least two of the interconnected extensions are spring-biased relative to each other.

3. The extension ladder stabilizer according to either claims 1 or 2 wherein two corresponding, intermediately disposed extensions are set at open right angles to each other to form a positive right angle, external corner building engager.

4. The extension ladder stabilizer according to either claims 1 or 2 wherein two corresponding extensions are set at closed right angles to each other to form a negative right angle internal corner building engager.

5. The extension ladder stabilizer according to either claims 1 or 2 wherein two corresponding intermediately disposed extensions are set in spaced parallel relation to each other and at right angles to the connector to form a building overhang attachment.

6. The extension ladder stabilizer according to claim 5 wherein end articulable extensions are set in-line with the intermediate extensions of from therewith an extended overhang attachment.

7. The extension ladder stabilizer according to either claims 1 or 2 wherein articulable end extensions are set in spaced parallel relation to each other to form with intermediate extensions a spanner to engage exposed windows adjacent opposed frame sides thereof.

* * * * *